US012582270B1

(12) United States Patent
Simpson

(10) Patent No.: US 12,582,270 B1
(45) Date of Patent: Mar. 24, 2026

(54) EXTENDABLE TOILET PAPER ROLL HOLDER

(71) Applicant: Peter Simpson, Palm Bay, FL (US)

(72) Inventor: Peter Simpson, Palm Bay, FL (US)

( * ) Notice: Subject to any disclaimer, the term of this patent is extended or adjusted under 35 U.S.C. 154(b) by 79 days.

(21) Appl. No.: 18/663,250

(22) Filed: May 14, 2024

(51) Int. Cl.

| | |
|---|---|
| ***A47K 10/22*** | (2006.01) |
| ***A47K 10/32*** | (2006.01) |
| ***A47K 10/34*** | (2006.01) |
| ***A47K 10/36*** | (2006.01) |
| ***A47K 10/38*** | (2006.01) |
| ***A47K 10/40*** | (2006.01) |

(52) U.S. Cl.

CPC ..... *A47K 10/22* (2013.01); *A47K 10/32* (2013.01); *A47K 10/34* (2013.01); *A47K 10/3687* (2013.01); *A47K 10/38* (2013.01); *A47K 10/40* (2013.01); *A47K 2010/3233* (2013.01); *A47K 2010/3253* (2013.01); *A47K 2201/02* (2013.01)

(58) Field of Classification Search

CPC .... A47K 10/22; A47K 10/38; A47K 10/3687; A47K 10/40; A47K 10/405; A47K 2010/3253; A47K 2010/3233; A47K 2201/02; A47K 10/3809; A47K 10/3836; A47K 10/24; A47K 10/32; A47K 10/34; A47K 2101/324; A47K 2010/326; A47K 10/10; A47K 10/16; A47K 10/18

USPC ..... 242/591, 592, 594, 594.2, 594.3, 594.4, 242/594.5, 594.6, 596, 596.1, 596.3, 242/596.4, 596.8, 597, 597.4, 597.8, 598, 242/598.3, 598.4

See application file for complete search history.

(56) References Cited

U.S. PATENT DOCUMENTS

| | | | | | |
|---|---|---|---|---|---|
| 3,643,884 | A * | 2/1972 | Curtin | A47K 10/40 | 242/599.1 |
| 3,837,595 | A * | 9/1974 | Boone | A47K 10/32 | 242/598.5 |
| 5,255,861 | A * | 10/1993 | Lerner | A47K 10/40 | 242/598 |
| 5,868,345 | A | 2/1999 | Beisser | | |
| 5,871,170 | A * | 2/1999 | Morales | A47K 10/40 | 242/598.2 |
| 5,967,452 | A | 10/1999 | Wilder | | |
| 6,056,233 | A * | 5/2000 | Von Schenk | A47K 10/40 | 242/598.5 |
| 6,367,734 | B1 * | 4/2002 | Cartwright | A47K 10/40 | 242/598.3 |

(Continued)

FOREIGN PATENT DOCUMENTS

| | | | | |
|---|---|---|---|---|
| DE | 19545440 | C2 * | 12/2002 | A47K 10/3836 |
| JP | 2005152249 | A * | 6/2005 | A47K 10/38 |
| WO | 2021202168 | | 10/2021 | |

*Primary Examiner* — Sang K Kim
*Assistant Examiner* — Raveen J Dias
(74) *Attorney, Agent, or Firm* — Kyle A. Fletcher, Esq.

(57) ABSTRACT

The extendable toilet paper roll holder includes a toilet paper holder, a scissoring arm, and a mounting base. The toilet paper holder may be configured to hold a plurality of toilet paper rolls. Toilet paper may be dispensed from the plurality of toilet paper rolls while the plurality of toilet paper rolls are coupled to the toilet paper holder. The mounting base may be operable to mount the extendable toilet paper roll holder to a stable base. The scissoring arm may be operable to reposition the toilet paper holder closer to and farther away from the mounting base.

17 Claims, 5 Drawing Sheets

(56) References Cited

U.S. PATENT DOCUMENTS

| | | | | |
|---|---|---|---|---|
| 6,378,800 | B1 * | 4/2002 | Apichom | A47K 10/40 242/560 |
| 6,402,085 | B1 * | 6/2002 | Smith | A47K 10/40 242/598.3 |
| 6,405,971 | B1 | 6/2002 | Trecartin | |
| 6,527,219 | B1 * | 3/2003 | Trecartin | A47K 10/38 242/598 |
| 6,945,493 | B1 * | 9/2005 | Gottesman | A47K 10/38 242/594.5 |
| 7,306,185 | B1 | 12/2007 | Miller | |
| 7,360,739 | B1 * | 4/2008 | Horvat | A47K 10/38 242/591 |
| 7,891,600 | B1 * | 2/2011 | Schmatz | B65H 75/241 242/598.3 |
| D660,981 | S | 5/2012 | Randall | |
| 10,743,725 | B2 | 8/2020 | Scheimberg | |
| 11,478,113 | B1 | 10/2022 | Spraul | |
| 11,529,027 | B2 | 12/2022 | Steinke | |
| 11,793,367 | B2 * | 10/2023 | Steinke | A47K 10/40 |
| 12,161,270 | B1 * | 12/2024 | Spraul | A47K 10/3836 |
| 2003/0141408 | A1 * | 7/2003 | Thompson | A47K 10/40 242/598.5 |
| 2012/0067998 | A1 * | 3/2012 | Dermo | B65H 75/08 242/599 |
| 2018/0333012 | A1 * | 11/2018 | Cuenca | A47K 10/3836 |
| 2019/0274493 | A1 * | 9/2019 | Scheimberg | A47K 10/22 |
| 2020/0129016 | A1 * | 4/2020 | Cuenca | A47K 10/3836 |
| 2021/0307568 | A1 * | 10/2021 | Steinke | A47K 10/3836 |
| 2023/0180974 | A1 * | 6/2023 | Brazelton | A47K 10/38 221/283 |
| 2023/0284840 | A1 * | 9/2023 | Steinke | A47K 10/22 |
| 2025/0275653 | A1 * | 9/2025 | Steinke | A47K 10/22 |

* cited by examiner

EXTENDABLE TOILET PAPER ROLL HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of toilet paper dispensers and extension arms, more specifically, an extendable toilet paper roll holder.

SUMMARY OF INVENTION

The extendable toilet paper roll holder may comprise a toilet paper holder, a scissoring arm, and a mounting base. The toilet paper holder may be configured to hold a plurality of toilet paper rolls. Toilet paper may be dispensed from the plurality of toilet paper rolls while the plurality of toilet paper rolls are coupled to the toilet paper holder. The mounting base may be operable to mount the extendable toilet paper roll holder to a stable base. The scissoring arm may be operable to reposition the toilet paper holder closer to and farther away from the mounting base. As non-limiting examples, the stable base may be a bathroom wall, a toilet stall wall, or a cabinet such that the scissoring arm extends and retracts horizontally or the stable base may be overhead such that the scissoring arm extends and retracts vertically.

An object of the invention is to provide a toilet paper holder operable to hold a plurality of toilet paper rolls.

Another object of the invention is to provide a mounting base to couple the invention to a stable base.

A further object of the invention is to provide a scissoring arm that may couple the toilet paper holder to the mounting base.

Yet another object of the invention is to provide a scissoring arm that may extend and retract to reposition the toilet paper holder.

These together with additional objects, features and advantages of the extendable toilet paper roll holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the extendable toilet paper roll holder in detail, it is to be understood that the extendable toilet paper roll holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the extendable toilet paper roll holder.

It is therefore important that the claims be regarded as including such equivalent construction insofar as they do not depart from the spirit and scope of the extendable toilet paper roll holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
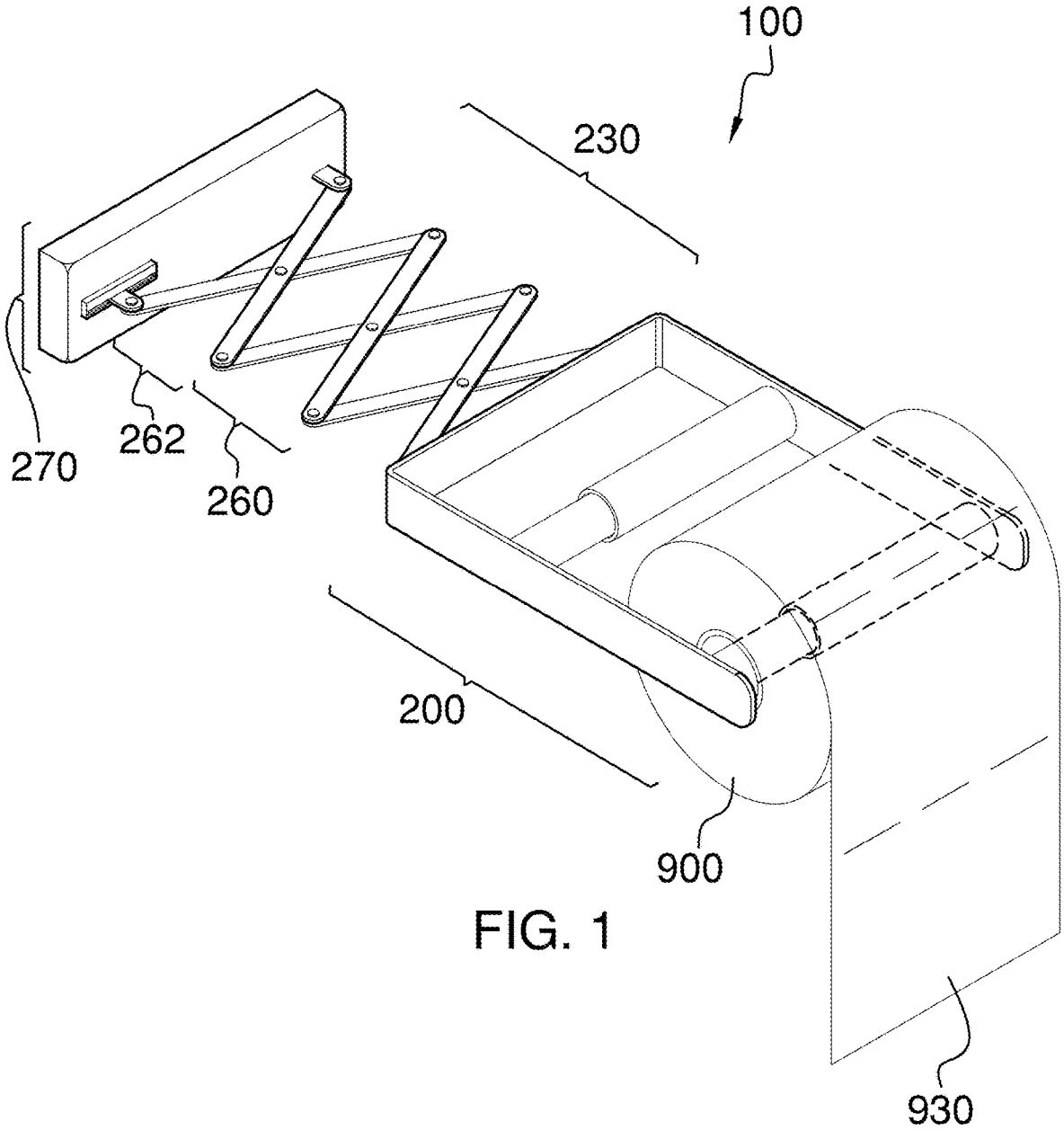
FIG. 1 is an isometric view of an embodiment of the disclosure.
Figure 2:
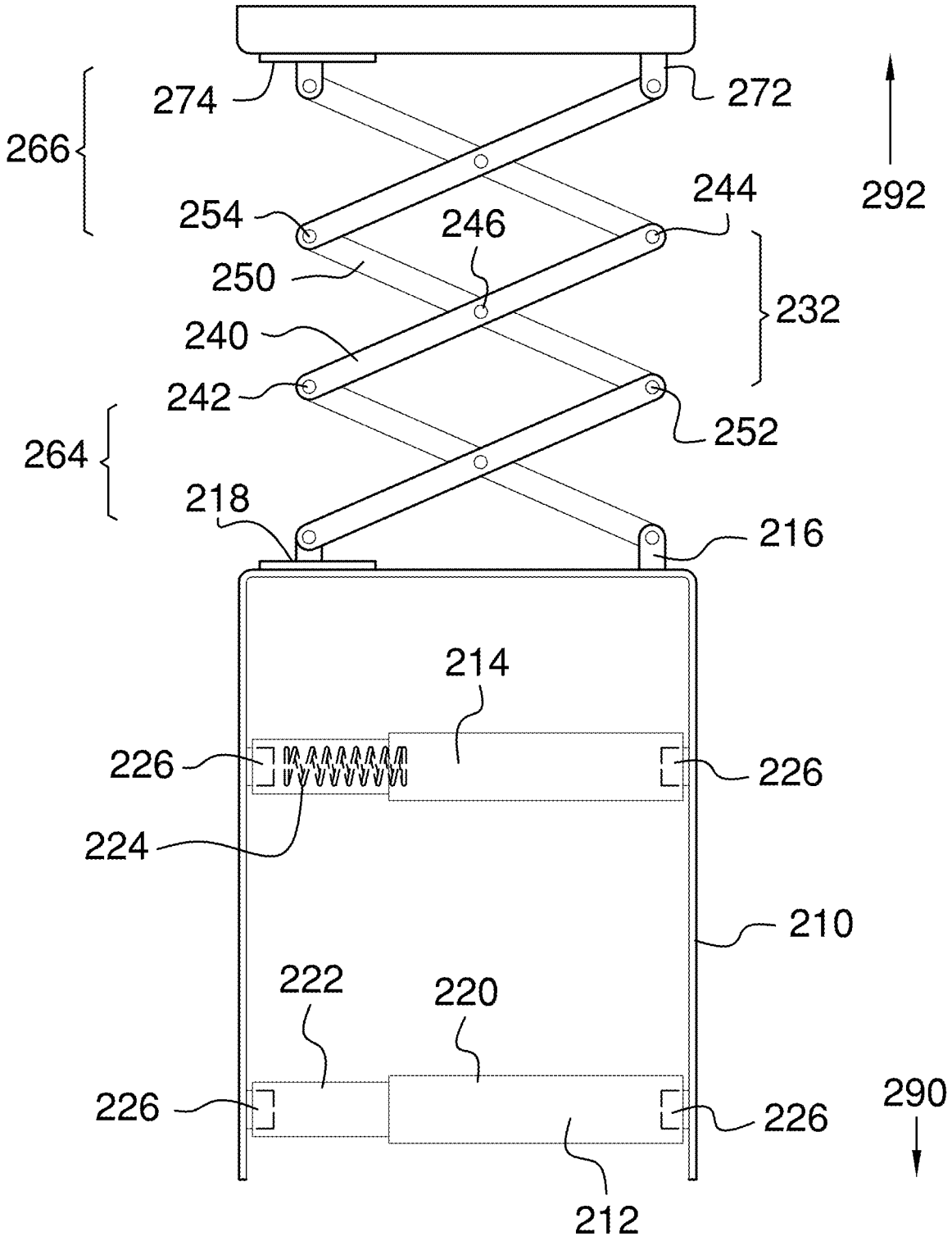
FIG. 2 is a top view of an embodiment of the disclosure, illustrating the scissoring arm when extended.
Figure 3:
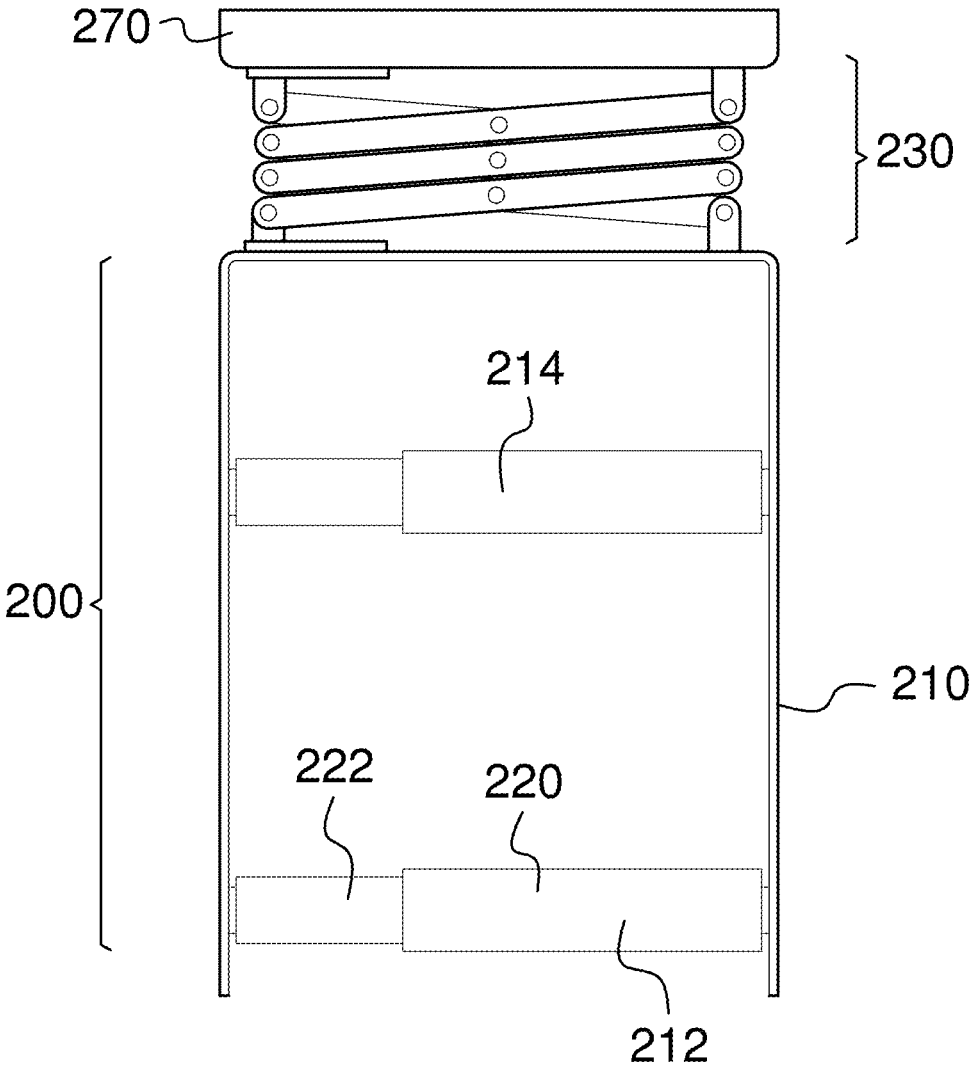
FIG. 3 is a top view of an embodiment of the disclosure, illustrating the scissoring arm when retracted.
Figure 4:
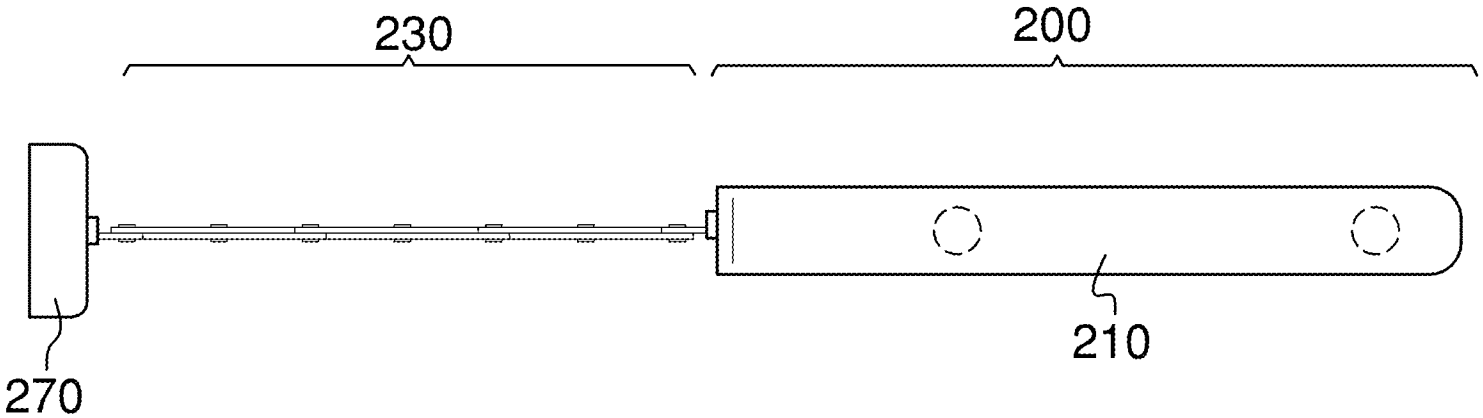
FIG. 4 is a side view of an embodiment of the disclosure.
Figure 5:
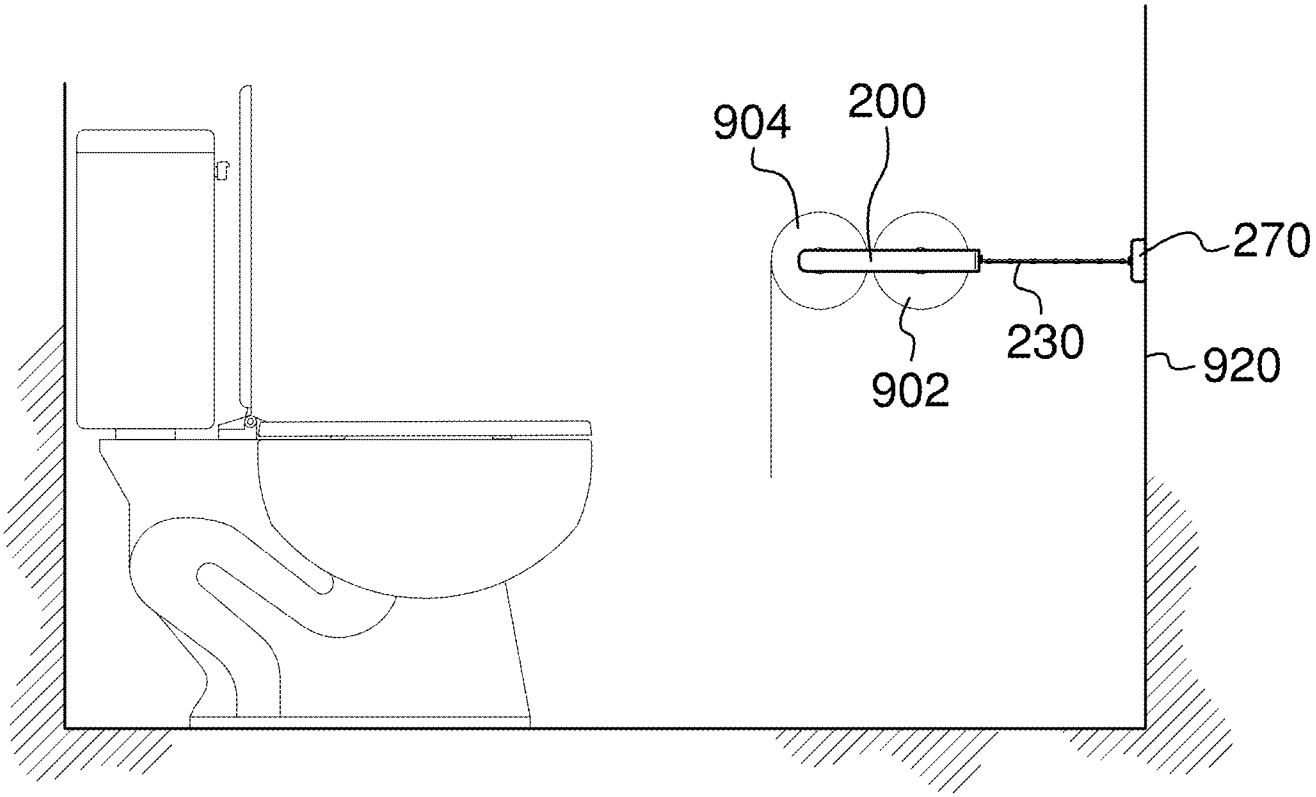
FIG. 5 is an in-use view of an embodiment of the disclosure.

Detailed reference will now be made to a first potential embodiment of the disclosure, which is illustrated in FIGS. 1 through 5.

The extendable toilet paper roll holder 100 (hereinafter invention) comprises a toilet paper holder 200, a scissoring arm 230, and a mounting base 270. The toilet paper holder 200 may be configured to hold a plurality of toilet paper rolls. Toilet paper 930 may be dispensed from the plurality of toilet paper rolls while the plurality of toilet paper rolls are coupled to the toilet paper holder 200. The mounting base 270 may be operable to mount the invention 100 to a stable base 920. The scissoring arm 230 may be operable to reposition the toilet paper holder 200 closer to and farther away from the mounting base 270. As non-limiting examples, the stable base 920 may be a bathroom wall, a toilet stall wall, or a cabinet such that the scissoring arm 230 extends and retracts horizontally or the stable base 920 may be overhead such that the scissoring arm 230 extends and retracts vertically.

The toilet paper holder 200 may comprise a U-frame 210, a first spindle 212, and a second spindle 214. The U-frame 210 may be a U-shaped armature coupled to a proximal end 290 of the scissoring arm 230. A distal end 292 of the scissoring arm 230 may be coupled to the mounting base 270.

The proximal end 290 of the U-frame 210 may be open to provide access to the plurality of toilet paper rolls. The first spindle 212 and the second spindle 214 may be removably coupled to the sides of the U-frame 210 such that the first spindle 212 is oriented to be parallel to the second spindle 214. The first spindle 212 and the second spindle 214 may be supported on the U-frame 210 by a plurality of spindle supports 226. The first spindle 212 may be removed from the U-frame 210, a first toilet paper roll 902 may be placed onto the first spindle 212, and the first spindle 212 may be replaced within the U-frame 210. The second spindle 214 may be removed from the U-frame 210, a second toilet paper roll 904 may be placed onto the second spindle 214, and the second spindle 214 may be replaced within the U-frame 210.

The distal end 292 of the U-frame 210 may comprise a fixed holder coupler 216 and a sliding holder coupler 218. The scissoring arm 230 may couple to the U-frame 210 via the fixed holder coupler 216 and the sliding holder coupler 218. The fixed holder coupler 216 may remain at a fixed position on the U-frame 210 as the scissoring arm 230 extends and retracts. The sliding holder coupler 218 may slidably change position on the U-frame 210 as the scissoring arm 230 extends and retracts in order to compensate for changes in the dimensions of the scissoring arm 230.

An individual spindle selected from the first spindle 212 and the second spindle 214 may comprise a first spindle half 220, a second spindle half 222, and a spindle spring 224. The first spindle half 220 and the second spindle half 222 may be hollow cylinders. The inside diameter of the first spindle half 220 may be larger than the outside diameter of the second spindle half 222 such that the second spindle half 222 may telescopically slide into the first spindle half 220. The spindle spring 224 inside the individual spindle may be coupled to both the first spindle half 220 and the second spindle half 222 such that the spindle spring 224 may push the first spindle half 220 away from the second spindle half 222 to retain the individual spindle in the U-frame 210. The outside diameter of the first spindle half 220 may be smaller than the inside diameter of the aperture in a toilet paper roll 900 such that the individual spindle may fit within the toilet paper roll 900.

The scissoring arm 230 may be a mechanical linkage system comprising a plurality of scissor sections. The plurality of scissor sections may be coupled end-to-end to form the scissoring arm 230. The longitudinal length of the scissoring arm 230 may change while the scissoring arm 230 continues to point in the same direction.

An individual scissor section 232 selected from the plurality of scissor sections may comprise a first scissor armature 240 and a second scissor armature 250. The first scissor armature 240 may be pivotably coupled to the second scissor armature 250 at a scissor pivot 246 located at the center of the first scissor armature 240 and the center of the second scissor armature 250.

The first scissor armature 240 may comprise a first proximal pivot 242 located at the proximal end 290 of the first scissor armature 240 and a first distal pivot 244 located at the distal end 292 of the first scissor armature 240. The second scissor armature 250 may comprise a second proximal pivot 252 located at the proximal end 290 of the second scissor armature 250 and a second distal pivot 254 located at the distal end 292 of the second scissor armature 250. The first distal pivot 244 of a first scissor section 260 may be pivotably coupled to the second proximal pivot 252 of a second scissor section 262 and the second distal pivot 254 of the first scissor section 260 may be pivotably coupled to the first proximal pivot 242 of the second scissor section 262.

The mounting base 270 may be coupled to the stable base 920 in order to support the invention 100. The mounting base 270 may comprise a fixed base coupler 272 and a sliding base coupler 274. The scissoring arm 230 may couple to the mounting base 270 via the fixed base coupler 272 and the sliding base coupler 274. The fixed base coupler 272 may remain at a fixed position on the mounting base 270 as the scissoring arm 230 extends and retracts. The sliding base coupler 274 may slidably change position on the mounting base 270 as the scissoring arm 230 extends and retracts in order to compensate for changes in the dimensions of the scissoring arm 230.

A most proximal scissor section 264 of the scissoring arm 230 may be coupled to the toilet paper holder 200. Specifically, the second proximal pivot 252 of the most proximal scissor section 264 may be pivotably coupled to the sliding holder coupler 218 of the toilet paper holder 200 and the first proximal pivot 242 of the most proximal scissor section 264 may be pivotably coupled to the fixed holder coupler 216 of the toilet paper holder 200.

A most distal scissor section 266 of the scissoring arm 230 may be coupled to the mounting base 270. Specifically, the first distal pivot 244 of the most distal scissor section 266 may be pivotably coupled to the sliding base coupler 274 of the mounting base 270 and the second distal pivot 254 of the most distal scissor section 266 may be pivotably coupled to the fixed base coupler 272 of the mounting base 270.

The scissoring arm 230 may be lengthened to reposition the toilet paper holder 200 by grasping the toilet paper holder 200 and pulling the toilet paper holder 200 away from the mounting base 270. Responsive to lengthening the scissoring arm 230, the first scissor armature 240 and the second scissor armature 250 of all of the individual scissor sections 232 comprising the scissoring arm 230 may pivot at the scissor pivot 246 such that the first proximal pivot 242 moves towards the second proximal pivot 252 and the first proximal pivot 242 moves away from the second distal pivot 254 thus making the individual scissor sections 232 longer and narrower. In addition, the sliding holder coupler 218 may move towards the fixed holder coupler 216 and the sliding base coupler 274 may move towards the fixed base coupler 272.

The scissoring arm 230 may be shortened to reposition the toilet paper holder 200 by grasping the toilet paper holder 200 and pushing the toilet paper holder 200 towards the mounting base 270. Responsive to shortening the scissoring arm 230, the first scissor armature 240 and the second scissor armature 250 of all of the individual scissor sections 232 comprising the scissoring arm 230 may pivot at the scissor pivot 246 such that the first proximal pivot 242 moves away from the second proximal pivot 252 and the first proximal pivot 242 moves towards the second distal pivot 254 thus making the individual scissor sections 232 shorter and wider. In addition, the sliding holder coupler 218 may move away from the fixed holder coupler 216 and the sliding base coupler 274 may move away from the fixed base coupler 272.

In use, the mounting base 270 may be coupled to a stable base 920. As non-limiting examples, the stable base 920 may be a bathroom wall, a toilet stall wall, or a cabinet such that the scissoring arm 230 extends and retracts horizontally or the stable base 920 may be overhead such that the scissoring arm 230 extends and retracts vertically. The first toilet paper roll 902 may be placed onto the first spindle 212, the second toilet paper roll 904 may be placed onto the second spindle 214, and the spindles may be coupled to the U-frame 210 of the toilet paper holder 200. A user may extend the scissoring arm 230 to reach the toilet paper 930 and may retract the scissoring arm 230 to move the toilet paper holder 200 out of the way. When the first toilet paper roll 902 is empty, the user may use the second toilet paper roll 904.

Definitions

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, "horizontal" may be a directional term that refers to a direction that is perpendicular to the local force of gravity. Unless specifically noted in this disclosure, the horizontal direction is always perpendicular to the vertical direction.

As used herein, "inside diameter" or "inner diameter" may refer to a measurement made on a hollow object. Specifically, the inside diameter is the distance from one inside wall to the opposite inside wall.

As used herein, the word "longitudinal" or "longitudinally" may refer to a lengthwise or longest direction or to a direction that is perpendicular to the lateral direction.

As used in this disclosure, a "mechanical linkage" may be an interconnected arrangement of components that are used to manage the transfer of a movement or a force. A mechanical linkage is often referred to as a linkage.

As used herein, "outside diameter" or "outer diameter" may refer to a measurement made on an object. Specifically, the outside diameter is the distance from one point on the outside of the object to a point on the opposite side of the object along a line passing through the center of the object.

As used herein, the word "pivot" may include any mechanical arrangement that allows for rotational motion. Non-limiting examples of pivots may include hinges, holes, posts, dowels, pins, points, rods, rivets, shafts, balls, and sockets, either individually or in combination.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "telescopic", "telescoping", and "telescopically" may refer to an object made of two or more sections that fit or slide into each other such that the object can be made longer or shorter by adjusting the relative positions of the sections.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An extendable toilet paper roll holder comprising:

a toilet paper holder, a scissoring arm, and a mounting base;

wherein the toilet paper holder is configured to hold a plurality of toilet paper rolls;

wherein toilet paper is dispensed from the plurality of toilet paper rolls while the plurality of toilet paper rolls are coupled to the toilet paper holder;

wherein the mounting base is operable to mount the extendable toilet paper roll holder to a stable base; wherein the mounting base comprises a fixed base coupler and a sliding base coupler; wherein the scissoring arm is operable to reposition the toilet paper holder closer to and farther away from the mounting base;

wherein the toilet paper holder is further defined with a U-frame;

wherein a distal end of the U-frame comprises a fixed holder coupler and a sliding holder coupler;

wherein the scissoring arm couples to the U-frame via the fixed holder coupler and the sliding holder coupler;

wherein a first scissor armature of the scissoring arm comprises a first proximal pivot located at a proximal end of the first scissor armature and a first distal pivot located at a distal end of the first scissor armature;

wherein a second scissor armature of the scissoring arm comprises a second proximal pivot located at a proximal end of the second scissor armature and a second distal pivot located at a distal end of the second scissor armature;

wherein the first distal pivot is pivotably coupled to the sliding base coupler of the mounting base and the second distal pivot is pivotably coupled to the fixed base coupler of the mounting base.

2. The extendable toilet paper roll holder according to claim 1 wherein the toilet paper holder comprises the U-frame, a first spindle, and a second spindle;

wherein the U-frame is a U-shaped armature coupled to a proximal end of the scissoring arm;

wherein a distal end of the scissoring arm is coupled to the mounting base.

3. The extendable toilet paper roll holder according to claim 2 wherein a proximal end of the U-frame is open to provide access to the plurality of toilet paper rolls;

wherein the first spindle and the second spindle are removably coupled to the sides of the U-frame such that the first spindle is oriented to be parallel to the second spindle.

4. The extendable toilet paper roll holder according to claim 3 wherein the first spindle and the second spindle are supported on the U-frame by a plurality of spindle supports.

5. The extendable toilet paper roll holder according to claim 3 wherein a first toilet paper roll is placed onto the first spindle;

wherein a second toilet paper roll is placed onto the second spindle.

6. The extendable toilet paper roll holder according to claim 5 wherein the fixed holder coupler remains at a fixed position on the U-frame as the scissoring arm extends and retracts;

wherein the sliding holder coupler slidably changes position on the U-frame as the scissoring arm extends and retracts in order to compensate for changes in the dimensions of the scissoring arm.

7. The extendable toilet paper roll holder according to claim 6 wherein an individual spindle selected from the first spindle and the second spindle comprises a first spindle half, a second spindle half, and a spindle spring;

wherein the first spindle half and the second spindle half are hollow cylinders;

wherein an inside diameter of the first spindle half is larger than an outside diameter of the second spindle half such that the second spindle half telescopically slides into the first spindle half.

8. The extendable toilet paper roll holder according to claim 7 wherein the spindle spring inside the individual spindle is coupled to both the first spindle half and the second spindle half such that the spindle spring pushes the first spindle half away from the second spindle half to retain the individual spindle in the U-frame.

9. The extendable toilet paper roll holder according to claim 8 wherein an outside diameter of the first spindle half is smaller than an inside diameter of an aperture in a toilet paper roll such that the individual spindle fits within the toilet paper roll.

10. The extendable toilet paper roll holder according to claim 9 wherein the scissoring arm is a mechanical linkage system comprising a plurality of scissor sections;

wherein the plurality of scissor sections are coupled end-to-end to form the scissoring arm;

wherein a longitudinal length of the scissoring arm changes while the scissoring arm continues to point in the same direction.

11. The extendable toilet paper roll holder according to claim 10 wherein each of the scissor sections comprises the first scissor armature and the second scissor armature;

wherein the first scissor armature is pivotably coupled to the second scissor armature at a scissor pivot located at a center of the first scissor armature and a center of the second scissor armature.

12. The extendable toilet paper roll holder according to claim 11 wherein the first distal pivot of a first scissor section of the scissor sections is pivotably coupled to the second proximal pivot of a second scissor section of the scissor sections and the second distal pivot of the first scissor section is pivotably coupled to the first proximal pivot of the second scissor section.

13. The extendable toilet paper roll holder according to claim 12 wherein the mounting base is coupled to the stable base in order to support the extendable toilet paper roll holder; wherein the scissoring arm couples to the mounting base via the fixed base coupler and the sliding base coupler.

14. The extendable toilet paper roll holder according to claim 13 wherein the fixed base coupler remains at a fixed position on the mounting base as the scissoring arm extends and retracts;

wherein the sliding base coupler slidably changes position on the mounting base as the scissoring arm extends and retracts in order to compensate for changes in the dimensions of the scissoring arm.

15. The extendable toilet paper roll holder according to claim 14 wherein the second proximal pivot is pivotably coupled to the sliding holder coupler of the toilet paper holder and the first proximal pivot is pivotably coupled to the fixed holder coupler of the toilet paper holder.

16. The extendable toilet paper roll holder according to claim 15 wherein the scissoring arm is lengthened to reposition the toilet paper holder by grasping the toilet paper holder and pulling the toilet paper holder away from the mounting base;

wherein responsive to lengthening the scissoring arm, the first scissor armature and the second scissor armature of all of the individual scissor sections comprising a scissoring arm pivot at the scissor pivot such that the first proximal pivot moves towards the second proximal pivot and the first proximal pivot moves away from the second distal pivot thus making the individual scissor sections longer and narrower;

wherein the sliding holder coupler moves towards the fixed holder coupler and the sliding base coupler moves towards the fixed base coupler.

17. The extendable toilet paper roll holder according to claim 16 wherein the scissoring arm is shortened to reposition the toilet paper holder by grasping the toilet paper holder and pushing the toilet paper holder towards the mounting base;

wherein responsive to shortening the scissoring arm, the first scissor armature and the second scissor armature of all of the individual scissor sections comprising the scissoring arm pivot at the scissor pivot such that the first proximal pivot moves away from the second proximal pivot and the first proximal pivot moves towards the second distal pivot thus making the individual scissor sections shorter and wider;

wherein the sliding holder coupler moves away from the fixed holder coupler and the sliding base coupler moves away from the fixed base coupler.

* * * * *